US007401553B2

(12) United States Patent
Glunz et al.

(10) Patent No.: US 7,401,553 B2
(45) Date of Patent: Jul. 22, 2008

(54) PRINTING PLATE CARTRIDGE FOR A PRESS AND PRESS

(75) Inventors: Wolfgang Glunz, Augsburg (DE); Albert Heller, Pestenacker (DE); Georg Kässmair, Zusamzell (DE); Michael Scholz, Münsterhausen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 497 days.

(21) Appl. No.: 11/122,530

(22) Filed: May 5, 2005

(65) Prior Publication Data

US 2005/0263024 A1 Dec. 1, 2005

(30) Foreign Application Priority Data

May 5, 2004 (DE) ..... 10 2004 022 089

(51) Int. Cl.
*B41F 27/12* (2006.01)

(52) U.S. Cl. ..... 101/477; 101/479; 101/480

(58) Field of Classification Search ..... 101/477, 101/479, 480; 396/517
See application file for complete search history.

(56) References Cited

U.S. PATENT DOCUMENTS 5,555,810 A * 9/1996 Stiel ..... 101/477
5,595,119 A 1/1997 Hada et al.
5,809,360 A * 9/1998 Blake et al. ..... 396/517
6,393,986 B1 5/2002 Tobe et al.

FOREIGN PATENT DOCUMENTS

| | | | |
|---|---|---|---|
| DE | 3940795 | C2 | 6/1991 |
| DE | 4224832 | A1 | 3/1993 |
| DE | 10238107 | A1 | 3/2004 |
| DE | 10238125 | B3 | 3/2004 |
| EP | 0734860 | A1 | 10/1996 |
| JP | 61248834 | A | 11/1986 |

* cited by examiner

*Primary Examiner*—Leslie J Evanisko
(74) *Attorney, Agent, or Firm*—Leydig, Voit & Mayer, Ltd.

(57) ABSTRACT

A printing plate cartridge for a press including a housing having an old printing compartment for holding a printing plate to be removed during a printing plate change and a new printing plate compartment for holding a printing plate to be mounted on a form cylinder of a press during a printing plate change. A printing plate to be mounted on the form cylinder is removable from the new printing plate compartment via a first opening for feeding to the form cylinder during a printing plate changing operation. A printing plate to be removed from the form cylinder is capable of being fed to the old printing plate compartment via the first opening during a printing plate changing operation.

13 Claims, 5 Drawing Sheets

PRINTING PLATE CARTRIDGE FOR A PRESS AND PRESS

FIELD OF THE INVENTION

The invention relates to a printing plate cartridge for a press and to a press having a printing plate cartridge.

BACKGROUND OF THE INVENTION

Presses, such as web-fed presses, typically have a plurality of printing units arranged one after another. A printing material is moved successively through the various printing units in order to print the printing material. For half-tone overprinting, four printing units are generally provided with one of the process colors black, cyan, magenta and yellow being applied to the printing material in each printing unit. In web-fed presses, each printing unit typically comprises two printing-unit assemblies. The upper side and the underside of the printing material are printed at the same time by these printing-unit assemblies. Each of the printing-unit assemblies comprises a form cylinder, on which a printing plate is clamped for the purpose of printing. If, for example, a production change is carried out on the press, then it is necessary, inter alia, to remove an old, used printing plate from the form cylinder and to mount a new printing plate. In such a case, the removed printing plate is fed into a printing plate cartridge associated with the printing-unit assembly. The new printing plate to be mounted is also kept ready in the printing plate cartridge.

A printing plate cartridge for a press is disclosed in DE 102 38 107 A1. This printing plate cartridge has a shaft or old compartment for holding a used printing form to be removed and a shaft or a new compartment for holding a new printing form to be mounted on the respective form cylinder. With this device, a used printing form or printing plate removed from the form cylinder is fed into the printing plate cartridge. A new printing plate is removed and is fed to the form cylinder, via a side surface of the printing plate cartridge. The removal of a used printing plate from the printing plate cartridge and the feeding of a new printing plate into the printing plate cartridge by an operator are carried out via the same side surface.

BRIEF SUMMARY OF THE INVENTION

In view of the foregoing, a general object of the present invention is to provide an improved printing plate cartridge for a press. The printing plate cartridge according to the invention includes a housing comprising an upper side, an underside, a front side, a rear side and two narrow sides. The housing has an old compartment for holding a printing plate to be removed during a printing plate change and a new compartment for holding a printing plate to be mounted on a form cylinder of a press during a printing plate change.

At least one preferably closable opening can be integrated into the upper side or into the underside of the housing. For a printing plate change, a printing plate to be mounted on the form cylinder can be removed from the new compartment and fed to the form cylinder via this opening. A printing plate to be removed from the form cylinder also can be fed to the old compartment via the opening.

Additionally, an opening assigned to the new compartment and an opening assigned to the old compartment can be integrated into at least one of the narrow sides of the housing. For a printing plate change, a printing plate can be fed into the printing plate cartridge by an operator via the opening associated with the new compartment. A printing plate removed during the printing plate change can be removed from the printing plate cartridge by an operator via the opening associated with the old compartment.

Thus, according to the present invention, the printing plate exchange between the printing plate cartridge and the form cylinder can be carried out via the upper side or the underside of the housing of the printing plate cartridge. Additionally, the removal of a used printing plate and the feeding of a new printing plate into the printing plate cartridge can be carried out by an operator or printer via a narrow side of the housing that extends approximately at a right angle relative to the upper side or underside of the housing. In this way, an operator can fill a printing plate cartridge with a new printing plate and remove an old printing plate from the printing plate cartridge conveniently from the operating plane. This arrangement simplifies handling of the printing plates considerably.

BRIEF DESCRIPTION OF THE SEVERAL VIEWS OF THE DRAWING(S)

DETAILED DESCRIPTION OF THE INVENTION

Figure 1:
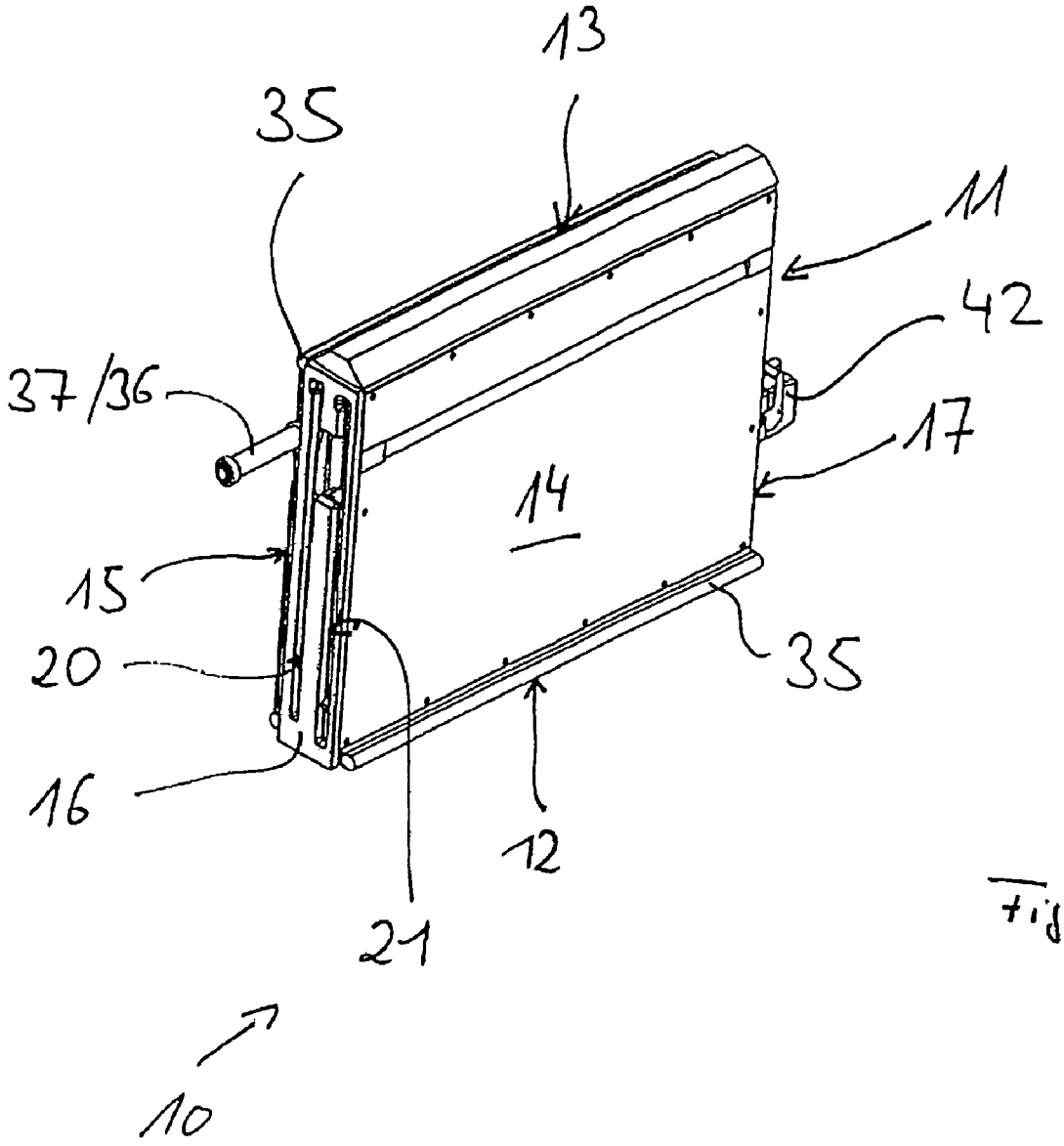
FIG. 1 is a side perspective view of an exemplary printing plate cartridge according to the invention.

Referring to FIG. 1 of the drawings, a printing plate cartridge 10 according to the invention is shown. The printing plate cartridge 10 includes a housing 11 comprising an underside 12, an upper side 13, a front side 14, a rear side 15 and two narrow sides 16 and 17. The printing plate cartridge 10 has an old printing plate compartment 18 for holding a used printing plate to be removed from a form cylinder and a new printing plate compartment 19 for holding a new printing plate to be fed to the form cylinder for mounting. A schematic view of the new printing plate compartment 19 of the printing plate cartridge 10 is provided in FIG. 2. A schematic view of the old printing plate compartment 18 is provided in FIG. 3.

A printing plate stored in the new printing plate compartment 19 that is to be mounted is fed in the direction of a form cylinder via an opening integrated into the upper side 13 or the underside 12 of the printing plate cartridge 10. According to the invention, an opening 20 assigned to the old printing plate compartment 18 and an opening 21 assigned to the new printing plate compartment 19 are integrated into the narrow side 16 that extends at right angles to the underside 12 and upper side 13. Via the opening 20 associated with the old printing plate compartment 18, an old printing plate removed during the printing plate changing operation can be removed from the printing plate cartridge 10 by an operator. On the other hand, a new printing plate needed for the printing plate changing operation and to be mounted can be inserted into the new printing plate compartment 19 by the operator or printer via the opening 21 associated with the new compartment 19. Accordingly, with the present invention present, the manual feeding and removal of printing plates into the printing plate cartridge 10 by the printer, and the automatic removal or feeding of printing plates from the printing plate cartridge 10 for the printing plate changing operation on the cylinder, are carried out via different sides of the housing 1 1 of the printing plate cartridge 10, namely via sides extending at right angles to each other.

Figure 6:
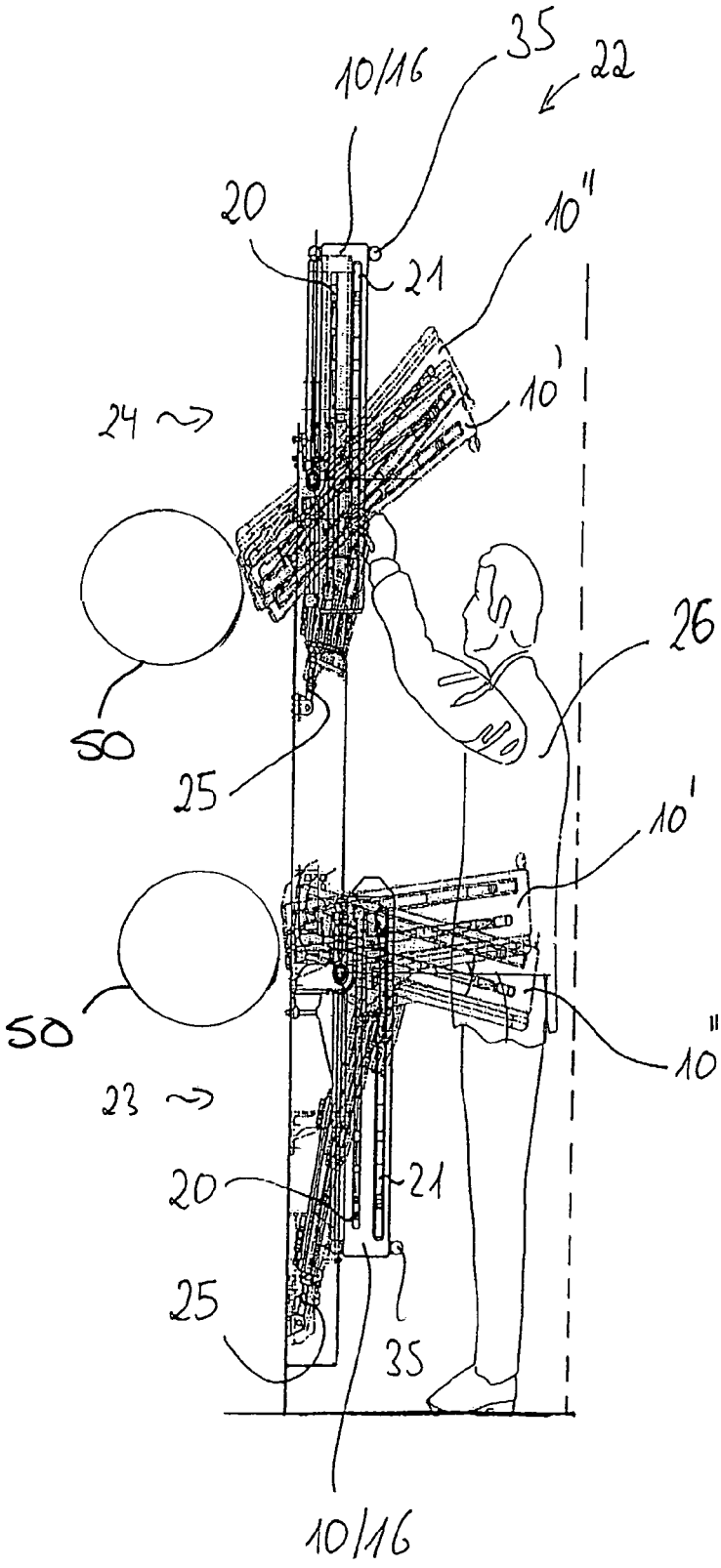
FIG. 6 is a side view of an illustrative printing unit of a press together with two printing plate cartridges according to the invention.
Figure 7:
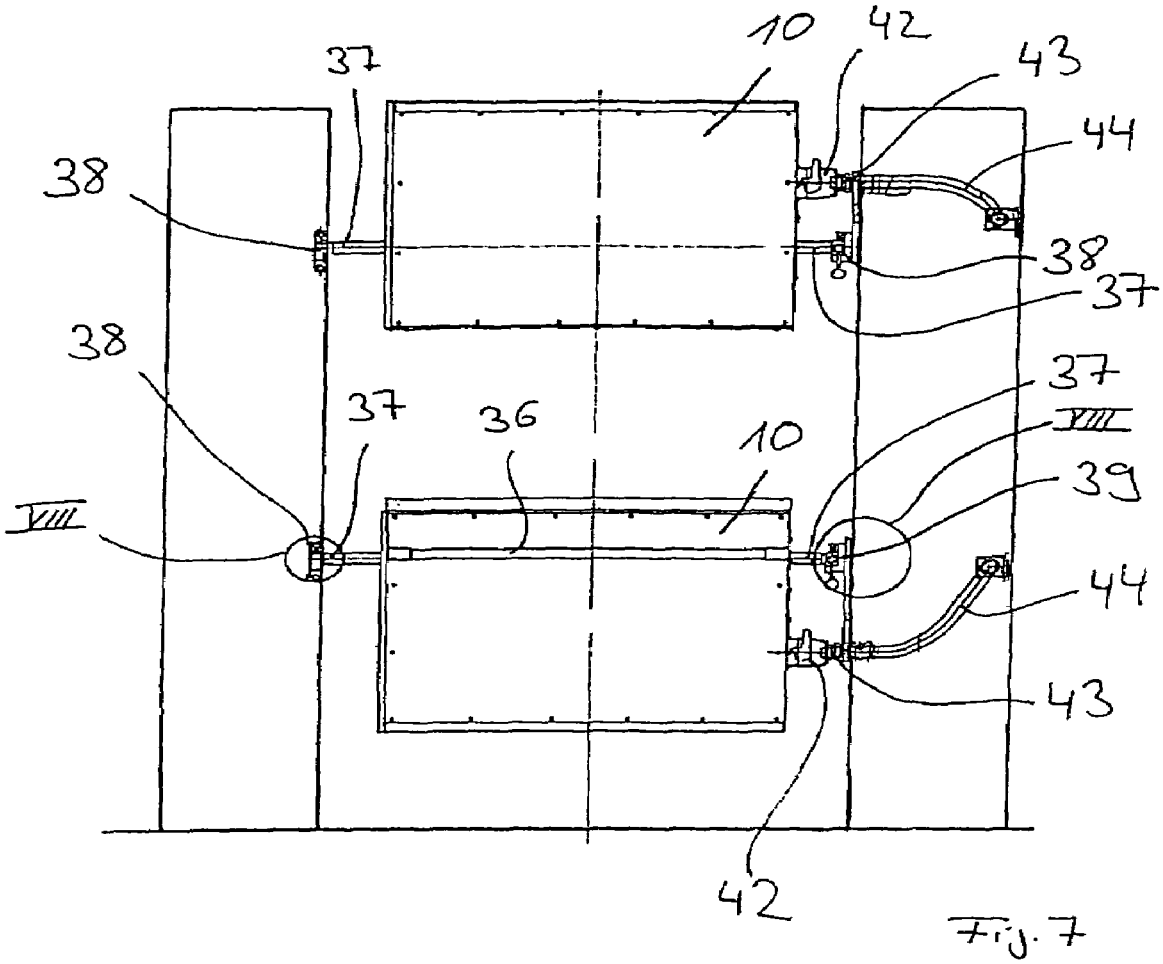
FIG. 7 is a front view of the printing unit and printing plate cartridges of FIG. 6.

A significant advantage of this configuration is shown in FIG. 6. FIG. 6 illustrates a detail from a printing unit 22 of a press. The printing unit 22 has a lower printing unit assembly 23 for printing an underside and an upper printing unit assembly 24 for printing an upper side of a printing material that is moved through between the two printing unit assemblies. Each of the printing unit assemblies includes a form cylinder together with a printing plate (schematically shown and collectively referenced as 50 in FIG. 6 ). In the area of each of the two printing unit assemblies 23 and 24, a printing plate cartridge 10 is arranged that is pivoted from the vertical or upright rest position during the printing plate change into positions identified by reference numbers 10' for removing the printing plate and feeding the removed printing plate into the old compartment 18. The printing plate cartridge also pivot into a position identified by the reference number 10" for the removal of a printing plate from the new compartment 10 and feeding the same to the form cylinder. The pivoting action is carried out by pivoting cylinders 25. As shown in FIG. 6, an operator 26 can remove printing plates from the printing plate cartridge 10 and feed in the printing plates via the openings 20 and 21 integrated into the narrow side 16 from the operating plane in the desk without the assistance of further aids, such as, for example, a ladder. For a printing plate changing operation, the printing plate change between the printing plate cartridges 10 and the form cylinder of the printing unit assemblies 23 and 24 is carried out in the area of the lower printing unit assembly 23 via the upper side 13 of the printing plate cartridge 10. In the region of the upper printing unit assembly 24, the printing plate changes is carried out via the underside 12 of the printing plate cartridge 10 and, therefore, via a side of the housing 11 of the respective printing plate cartridge 10 extending approximately at right angles to the narrow side 16.

According to another aspect of the present invention, the openings 20 and 21 via which the printer 26 inserts new printing plates into the new printing plate compartment 19 of the printing plate cartridge and removes old printing plates from the old printing plate compartment 18 have a specific contour. In particular, the opening 21 integrated into the narrow side 16 and associated with the new printing plate compartment 19 is contoured such that the opening 21 tapers in the manner of a funnel from an outside of the housing 11 towards an inside of the new compartment 19. This taper thereby forms an insertion or centering aid during the manual insertion of a new printing plate into the new printing plate compartment 19 of the printing plate cartridge 10. In contrast, the opening 20 integrated into the narrow side 16 and associated with the old printing plate compartment 18 is contoured in such a way that the opening 20 widens in the manner of a funnel from the outside of the housing 11 towards the inside of the old compartment 18. This arrangement eases removal of a used printing plate from the old compartment 18.

Figure 2:
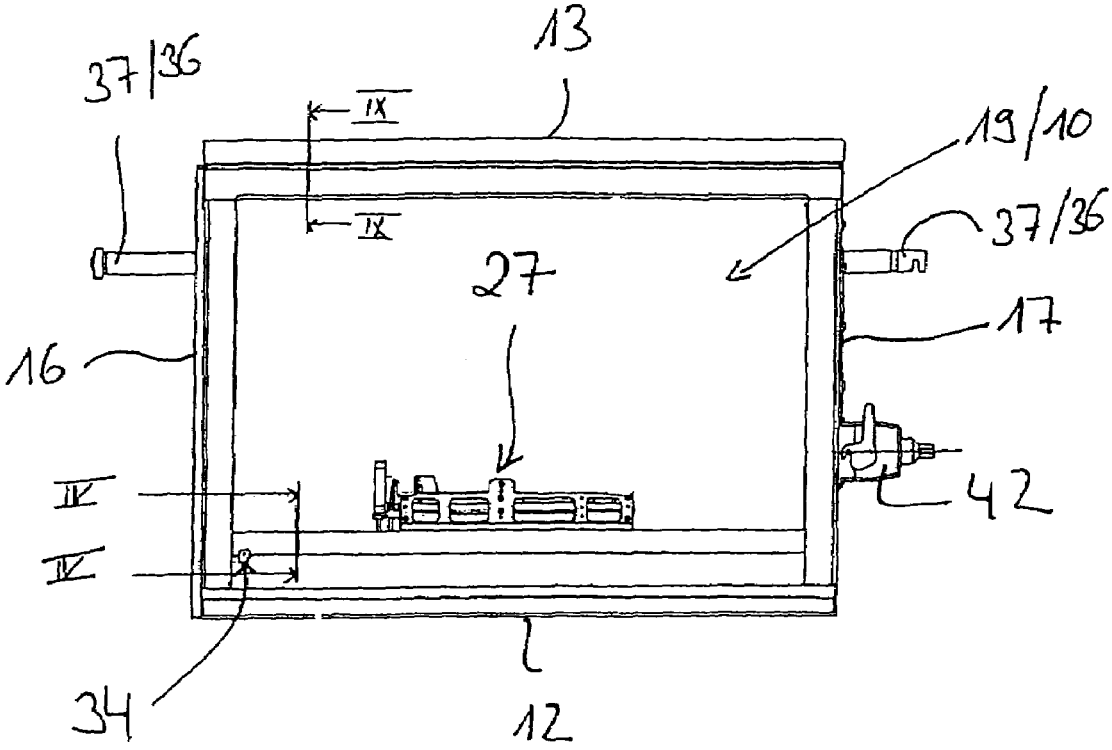
FIG. 2 is a side view of the printing plate cartridge of FIG. 1 showing the new printing plate compartment.
Figure 4:
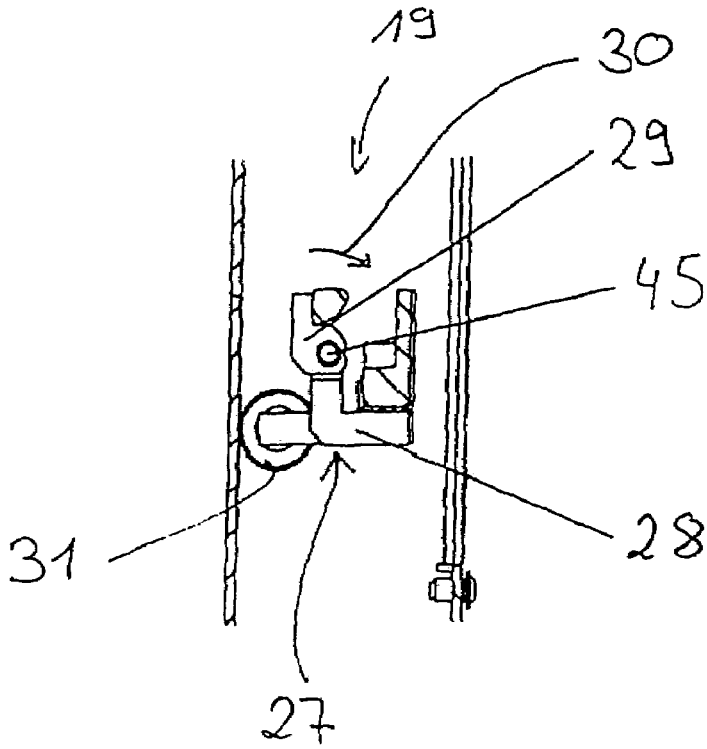
FIG. 4 is a cross-sectional view through the new printing plate compartment of the printing plate cartridge of FIG. 1 taken in the plane of line IV-IV in FIG. 2.

As shown in FIG. 2, a clamping element 27 is integrated into the new printing plate compartment 19 of the printing plate cartridge 10. FIG. 4 provides a cross sectional view through the clamping element 27 in the area of the new compartment 19. During the insertion of a printing plate needed for the printing plate changing operation into the new compartment 19 via the opening 21 integrated into the narrow side 16, one end of the printing plate is automatically gripped and held by the clamping element 27. In this process, the end of the printing plate is automatically pushed between a stationary clamping rail 28 and a clamping bar 29 fixed to the clamping rail 28 such that the printing plate can be pivoted. The clamping bar 29 is shown in a release position in FIG. 4. The ability of the clamping bar to pivot about a joint 45 into a clamping position is identified by an arrow 30 in FIG. 4. When a new printing plate is pushed into the new printing plate compartment 19 of the printing plate cartridge 10 via the opening 21, the clamping bar 29 (shown in the release position in FIG. 4) is pivoted into a clamping position.

In order to conduct a printing plate changing operation, specifically to feed the new printing plate from the new printing plate compartment 19 in the direction of the appropriate form cylinder of the press, the printing plate is moved partly out of the new compartment 19, via the opening integrated into the upper side 12 or underside 13, with the aid of the clamping element 27. In particular, the end of the printing plate is clamped in the clamping element 27 so that a leading end of the printing plate is moved into the area of a clamping channel of the form cylinder. After the leading end of the plate has been clamped in the clamping channel, the printing plate is tensioned by moving the clamping element 27 back. The printing plate is then released by pivoting the clamping bar 29 into the release position shown in FIG. 4. In this state, the printing plate can be pulled completely out of the new printing plate compartment 19 of the printing plate cartridge 10. In order to move the clamping element 27 within the new printing plate compartment 19, the new compartment 19 has an associated pneumatic cylinder or alternatively, for example, a motorized actuating drive. The movement of the clamping element 27 is made easier by rollers 31 assigned to the clamping rail 28.

Figure 3:
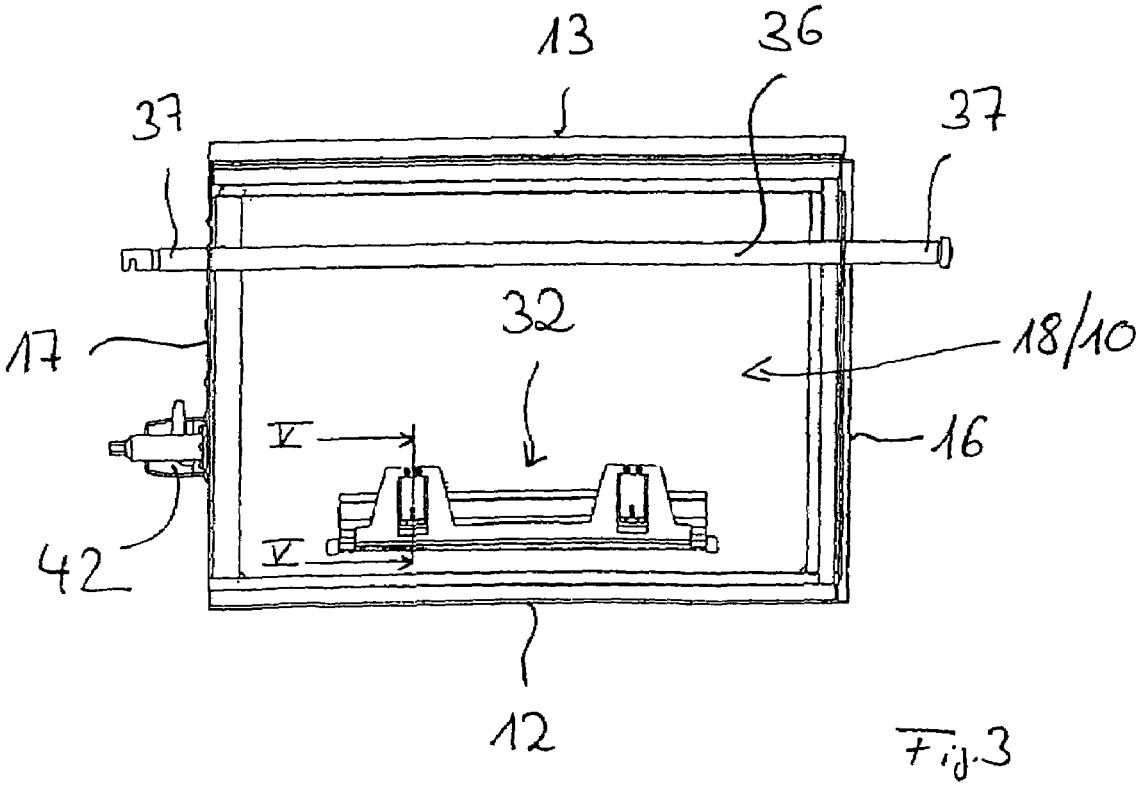
FIG. 3 is a side view of the printing plate cartridge of FIG. 1 showing the old printing plate compartment.
Figure 5:
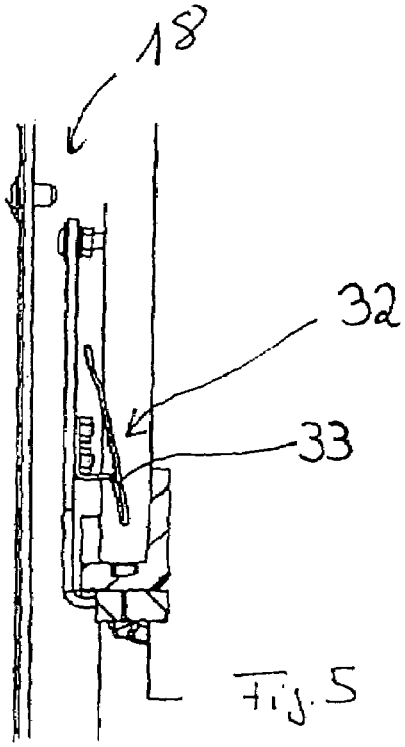
FIG. 5 is a cross sectional view through the old printing plate compartment of the printing plate cartridge of FIG. 1 taken in the plane of line V-V in FIG. 3.

As shown in FIG. 3, in the same way as in the new printing plate compartment 19, a clamping element 32 is integrated into the old printing plate compartment 18 of the printing plate cartridge 10. FIG. 5 provides a cross sectional view through the clamping element 32 in the area of the old compartment 18. The clamping element 32 integrated into the old compartment 18 is used to automatically grip an old printing plate to be removed during the printing plate changing operation. When the removed, old printing plate is inserted into the old compartment 18 via the upper side 13 of the printing plate cartridge 10, the end of the printing plate is gripped automatically by the clamping element 32, the clamping element 32 being formed as a holding element 33 like a barb. As the old, used printing plate is pushed into the old printing plate compartment 18 of the printing plate cartridge 10, the barb-like holding element 33 is pushed resiliently forward by the end of the printing plate, which has a U-shaped profile in cross section. After the end has been inserted completely into the clamping element 32, the holding element snaps back into the position shown in FIG. 5. The printing plate is then held securely in the old printing plate compartment 18 by the holding element 33. In order to move the clamping element 32 within the old printing plate compartment 18, the old printing plate compartment has an associated pneumatic cylinder or alternatively, for example, a motorized actuating drive.

As shown in FIG. 2, a sensor 34 that automatically detects the filling of the new printing plate compartment 19 with a printing plate needed for the printing plate changing operation, is integrated into the new compartment 19. The sensor first registers whether a printing plate is contained in the new compartment 19 and second whether this printing plate has been pushed completely into the new compartment 19.

According to FIG. 1 and 6, the housing 11 of printing plate cartridge 10 has associated switching elements 35 which, when actuated, automatically stop the printing plate cartridges 10 from being pivoted. In this case, the switching elements 35 are formed as switch strips. The significance of the switching elements 35 is best shown in FIG. 6. The printing plate cartridges 10 are shown in different positions in FIG. 6. If the operator, identified in FIG. 6 by the reference number 26, is in the area between two printing units, it must be ensured that the operator 26 is not clamped in between two printing units 22 as the printing plate cartridges 10 are pivoted. If the operator 26 were in position shown in FIG. 6 as the printing plate cartridges 10 were pivoted, then contact between a switching element 35 and the operator 26 would automatically actuate the switching element and the pivoting of the respective printing plate cartridge 10 would be automatically stopped.Accordingly, the switching elements 35 increases operational safety of a press equipped with such printing plate cartridges 10.

Figure 8:
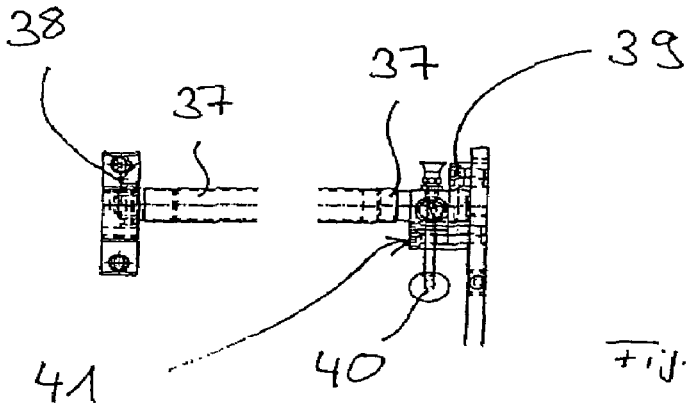
FIG. 8 is an enlarged view of the detail identified as VIII in FIG. 7.

According to FIGS. 2 and 3, the printing plate cartridge is penetrated by a tubular or rod-like fixing element 36 that enables the printing plate cartridge 10 to be fixed in holders 38 and 39 of a frame of the press of the printing unit 22 via ends 37. As shown in FIG. 8, the printing plate cartridge 10 is merely suspended with a first end 37 in the holding device 38 and an opposite, second end is inserted into the holding device 39. A locking mechanism 41 can be activated via a rotatable lever 40 so as to securely fix the printing plate cartridge 10 to the printing unit 22. The locking mechanism 41 can be deactivated by a simple rotation of the lever 40, and the printing plate cartridge 10 can be removed completely as a unit from the press.

As shown in FIGS. 2 and 3, a socket 42 is integrated into the narrow side 17 of the housing 11 of the printing plate cartridge 10. The socket is located opposite the narrow side 16 having the openings 20 and 21. A plug 43 of a cable 44 leading to the control electronics of the press can be plugged into the socket 42. When the plug 43 is inserted with contact into the socket 42, the control device of the press switches over automatically to a fully automatic printing plate change mode. On the other hand, if the plug 43 is removed from the socket 42, then the control system changes over automatically to a partly automatic printing plate change mode.

Figure 9:
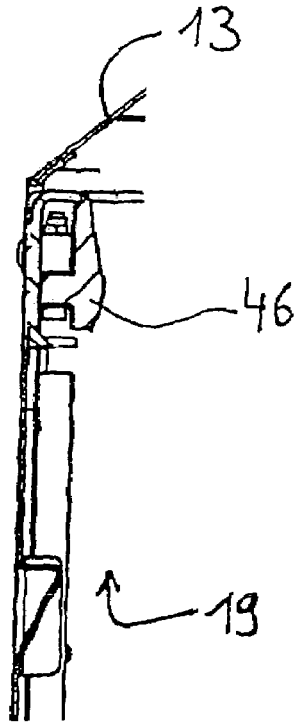
FIG. 9 is a cross sectional view through the new printing plate compartment of the printing plate cartridge of FIG. 1 taken in the plane of the line IX-IX in FIG. 2.

FIG. 9 shows a further detail of the printing plate cartridge 10 according to the invention in the area of the new compartment 19. In particular, the detail of FIG. 9 is at an end of the new compartment 19 at which a printing plate is moved out of the new printing plate compartment 19 through the opening integrated into the upper side 13 to be mounted a form cylinder. In this region, a deflection device 46 is integrated into the new printing plate compartment 19. The deflection device 46 places the printing plate under inherent tension as the printing plate is moved out of the new compartment 19. Accordingly, the contouring of the deflection device 46 determines the deflection of a new printing plate as the new printing plate is fed in the direction of the form cylinder.

The present invention provides a printing plate cartridge that an operator can fill with new printing plates in a particularly user-friendly manner, and from which used printing plates can also be easily removed. For an operator, the printing plate cartridge is accessible via a narrow side and therefore from the operating plane without further aids or tools. The feeding and removal of printing plates relative to a form cylinder of a printing unit of the press is carried out via an upper side or underside of the printing plate cartridge, running at right angles to this narrow side. The printing plate cartridge can be removed as a unit from the printing unit. When the printing plate cartridge is mounted, fully automatic printing plate change operation is possible and, when the printing plate cartridge is removed, partly automatic printing plate change operation is possible.

List of Reference Symbols

| | |
|---|---|
| 10. 10", 10" | Printing plate cartridge |
| 11. | Housing |
| 12. | Underside |
| 13. | Upper side |
| 14. | Front side |
| 15. | Rear side |
| 16. | Narrow side |
| 17. | Narrow side |
| 18. | Old printing plate compartment |
| 19. | New printing plate compartment |
| 20. | Opening |
| 21. | Opening |
| 22. | Printing unit |
| 23. | Printing unit assembly |
| 24. | Printing unit assembly |
| 25. | Pivoting cylinder |
| 26. | Printer |
| 27. | Clamping element |
| 28. | Clamping rail |
| 29. | Clamping bar |
| 30. | Arrow |
| 31. | Roller |
| 32. | Clamping element |
| 33. | Holding element |
| 34. | Sensor |
| 35. | Switching element |
| 36. | Fixing element |
| 37. | End |
| 38. | Holder |
| 39. | Holder |
| 40. | Lever |
| 41. | Locking mechanism |
| 42. | Socket |
| 43. | Plug |
| 44. | Cable |
| 45. | Joint |
| 46. | Deflection device |

The invention claimed is:

1. A printing plate cartridge for a press comprising;

a housing comprising an upper side, an underside, a front side, a rear side and two narrow sides, the housing including an old printing plate compartment for holding a printing plate to be removed during a printing plate changing operation and a new printing plate compartment for holding a printing plate to be mounted on a form cylinder of the press during the printing plate changing operation;

wherein a first opening is integrated into one of the upper side or the underside of the housing, a printing plate to be mounted on the form cylinder being removable from the new printing plate compartment via the first opening for feeding to the form cylinder during the printing plate changing operation and a printing plate to be removed from the form cylinder being capable of being fed to the old printing plate compartment via the first opening during the printing plate changing operation;

wherein a second opening assigned to the new printing plate compartment and a third opening assigned to the old printing plate compartment are integrated into one of the narrow sides of the housing, a printing plate needed for the printing plate changing operation being capable of being fed into the printing plate cartridge via the second opening and a printing plate removed during the printing plate changing operation being removable from the printing plate cartridge via the third opening associated with the old compartment.

2. The printing plate cartridge according to claim 1, wherein the second opening is contoured such that the second opening tapers in a funnel-like manner from an outside of the housing in the direction of an inside of the new printing plate compartment.

3. The printing plate cartridge according to claim 1, wherein the third opening is contoured such that the third opening widens in a funnel-like manner from an outside of the housing in the direction of an inside of the old printing plate compartment.

4. The printing plate cartridge according to claim 1, wherein a clamping element is integrated into the new printing plate compartment, an end of a printing plate needed for the printing plate changing operation being automatically gripped by the clamping element during insertion into the new printing plate compartment via the second opening.

5. The printing plate cartridge according to claim 4, wherein the clamping element automatically releases the end of the printing plate by pivoting a clamping bar after the printing plate to be mounted has been moved partly out of the new printing plate compartment via the first opening and after a leading end of the printing plate has been tensioned in a tensioning channel of the form cylinder.

6. The printing plate cartridge according to claim 1, wherein a clamping element is integrated into the old printing plate compartment, an end of a printing plate removed during the printing plate changing operation being automatically gripped by the clamping element during the insertion into the old printing plate compartment via the first opening.

7. The printing plate cartridge according to claim 6, wherein the clamping element integrated into the old printing plate compartment comprises a holding element.

8. The printing plate cartridge according to claim 7, wherein the clamping element integrated into the old printing plate compartment is pivotable about an axis into preferably into a first rest position, a second position for the removal of a printing plate and for the insertion of said printing plate into the old printing plate compartment, and into a third position for the removal of a printing plate from the new printing plate compartment and for mounting said printing plate on the form cylinder.

9. The printing plate cartridge according to claim 8, further including actuatable switching elements fixed to the outside of the housing that when actuated automatically stop the printing plate cartridge from being pivoted.

10. The printing plate cartridge according to claim 1, further including a first connector that is integrated into the housing and a mating second connector, the first and second connectors enabling the printing plate cartridge to be automatically switched from a partly automatic into a fully automatic printing plate change mode when the first and second connectors are connected.

11. The printing plate cartridge according to claim 1, wherein a sensor is integrated into the new printing plate compartment that automatically registers the filling of the new printing plate compartment with a printing plate needed for a printing plate changing operation.

12. The printing plate cartridge according to one or more of claim 1, wherein the printing plate cartridge is fixed to a press via a locking mechanism such that the printing plate cartridge can pivot relative to the press and the printing plate cartridge can be removed completely as a unit from the press without tools.

13. A web-fed press comprising:

a plurality of printing units, each printing unit having two printing unit assemblies for printing an upper side and an underside of a printing material, each printing unit assembly having a form cylinder bearing a printing plate, each printing unit assembly having an associated printing plate cartridge;

each printing plate cartridge including a housing comprising an upper side, an underside, a front side, a rear side and two narrow sides, the housing including an old printing plate compartment for holding a printing plate to be removed during a printing plate changing operation and a new printing plate compartment for holding a printing plate to be mounted on the associated form cylinder during the printing plate changing operation;

wherein a first opening is integrated into one of the upper side or the underside of the housing, a printing plate to be mounted on the associated form cylinder being removable from the new printing plate compartment via the first opening for feeding to the associated form cylinder during the printing plate changing operation and a printing plate to be removed from the associated form cylinder being capable of being fed to the old printing plate compartment via the first opening during the printing plate changing operation;

wherein a second opening assigned to the new printing plate compartment and a third opening assigned to the old printing plate compartment are integrated into one of the narrow sides of the housing, a printing plate needed for the printing plate changing operation being capable of being fed into the printing plate cartridge via the second opening associated and a printing plate removed during the printing plate changing operation being removable from the printing plate cartridge via the third opening associated with the old compartment.

* * * * *